US008229631B2

(12) United States Patent
Morey et al.

(10) Patent No.: US 8,229,631 B2
(45) Date of Patent: Jul. 24, 2012

(54) WHEEL TRACTOR SCRAPER PRODUCTION OPTIMIZATION

(75) Inventors: Stephen J. Morey, Peoria, IL (US); Timothy A. Vik, Sparland, IL (US); Quentin D. Burt, Forsyth, IL (US)

(73) Assignee: Caterpillar Inc., Peoria, IL (US)

( * ) Notice: Subject to any disclaimer, the term of this patent is extended or adjusted under 35 U.S.C. 154(b) by 1205 days.

(21) Appl. No.: 11/889,169

(22) Filed: Aug. 9, 2007

(65) Prior Publication Data

US 2009/0043460 A1 Feb. 12, 2009

(51) Int. Cl.
*G06F 7/00* (2006.01)

(52) U.S. Cl. ..... 701/50; 37/414

(58) Field of Classification Search ..... 701/50; 37/411, 414, 416, 419
See application file for complete search history.

(56) References Cited

U.S. PATENT DOCUMENTS

| | | | | |
|---|---|---|---|---|
| 4,024,710 | A | 5/1977 | Zelle | |
| 4,423,785 | A * | 1/1984 | Kurihara et al. | 172/3 |
| 4,597,050 | A | 6/1986 | Benson | |
| 4,757,454 | A | 7/1988 | Hisatake et al. | |
| 4,839,835 | A * | 6/1989 | Hagenbuch | 702/174 |
| 4,919,222 | A * | 4/1990 | Kyrtsos et al. | 177/139 |
| 5,070,953 | A * | 12/1991 | Kyrtsos et al. | 177/25.14 |
| 5,082,071 | A * | 1/1992 | Kyrtsos et al. | 177/25.14 |
| 5,105,896 | A * | 4/1992 | Kyrtsos | 177/139 |
| 5,220,968 | A * | 6/1993 | Weber | 177/25.14 |
| 5,361,211 | A | 11/1994 | Lee et al. | |
| 5,528,843 | A | 6/1996 | Rocke | |
| 5,531,122 | A | 7/1996 | Chatham et al. | |
| 5,553,407 | A | 9/1996 | Stump | |
| 5,564,507 | A | 10/1996 | Matsushita et al. | |
| 5,682,312 | A | 10/1997 | Rocke | |
| 5,712,782 | A | 1/1998 | Weigelt et al. | |
| 5,781,871 | A | 7/1998 | Mezger et al. | |
| 5,924,493 | A | 7/1999 | Hartman et al. | |
| 5,944,764 | A | 8/1999 | Henderson et al. | |
| 5,996,703 | A | 12/1999 | Yamamoto et al. | |
| 6,064,933 | A * | 5/2000 | Rocke | 701/50 |
| 6,125,561 | A | 10/2000 | Shull | |
| 6,167,336 | A * | 12/2000 | Singh et al. | 701/50 |
| 6,205,687 | B1 * | 3/2001 | Rocke | 37/348 |
| 6,247,538 | B1 * | 6/2001 | Takeda et al. | 172/2 |
| 6,336,068 | B1 * | 1/2002 | Lawson et al. | 701/50 |

(Continued)

FOREIGN PATENT DOCUMENTS

GB 2 386 447 A 9/2003

OTHER PUBLICATIONS

"Optimum Scraper Load Time," Caterpillar publication, 1994, 16 pages.

*Primary Examiner* — Helal A Algahaim
(74) *Attorney, Agent, or Firm* — Finnegan, Henderson, Farabow, Garrett & Dunner LLP

(57) ABSTRACT

A method for enhancing productivity for an excavating machine is disclosed. The method includes determining at least one cycle characteristic for an operating cycle of the excavating machine. The method also includes measuring payload accumulated by the machine during a loading phase of an operating cycle of the excavating machine. The method further includes controlling payload accumulated by the machine based on at least one of the at least one determined cycle characteristics.

5 Claims, 4 Drawing Sheets

U.S. PATENT DOCUMENTS

| | | | | |
|---|---|---|---|---|
| 6,691,010 | B1 * | 2/2004 | Gay | 701/50 |
| 6,725,105 | B2 | 4/2004 | Francis et al. | |
| 6,845,311 | B1 * | 1/2005 | Stratton et al. | 701/50 |
| 7,104,340 | B1 | 9/2006 | Thompson et al. | |
| 7,627,410 | B2 * | 12/2009 | Berry et al. | 701/50 |
| 2003/0176958 | A1 * | 9/2003 | Hagenbuch | 701/29 |
| 2005/0034902 | A1 * | 2/2005 | Madhavarao et al. | 177/136 |
| 2005/0085973 | A1 * | 4/2005 | Furem et al. | 701/50 |
| 2005/0179537 | A1 * | 8/2005 | Lewis | 340/506 |
| 2006/0090379 | A1 * | 5/2006 | Furem | 37/443 |
| 2007/0129869 | A1 * | 6/2007 | Gudat et al. | 701/50 |
| 2007/0193794 | A1 * | 8/2007 | Johnston et al. | 180/65.3 |
| 2007/0239338 | A1 * | 10/2007 | Potts et al. | 701/50 |
| 2008/0084334 | A1 * | 4/2008 | Ballew | 340/990 |
| 2008/0155866 | A1 | 7/2008 | Congdon et al. | |
| 2008/0183356 | A1 | 7/2008 | Kale et al. | |
| 2008/0208415 | A1 * | 8/2008 | Vik | 701/50 |
| 2008/0319618 | A1 * | 12/2008 | Sjogren et al. | 701/50 |
| 2009/0187527 | A1 * | 7/2009 | Mcaree et al. | 706/52 |

* cited by examiner

WHEEL TRACTOR SCRAPER PRODUCTION OPTIMIZATION

TECHNICAL FIELD

The present disclosure is directed to machine production optimization, and more particularly, to production optimization for operation of a wheel tractor scraper.

BACKGROUND

Earthmoving machines may be used to move earth, rocks, and other materials from an excavation site. Often, it may be desirable to move excavated material from an excavation site to another location sufficiently removed from the excavation site that the material must be transported some distance before being dumped. For example, the earth, rocks, and/or other materials may be loaded onto an off-highway haulage unit that may, in turn, transport the materials to a dump site. As another example, the material may be excavated by a pull pan drawn behind a tractor, and then hauled, via the pull pan, to the dump site. As a further example, a wheel tractor scraper may be used for excavating, hauling, and dumping the excavated material.

A wheel tractor scraper may be used in an operating cycle to cut material from one location during a load phase, transport the cut material to another location during a haul phase, unload the cut material during a dump phase, and return to an excavation site during a return phase to repeat the operating cycle. The decision to use a wheel tractor scraper, as opposed to some other excavating machine or system, may be based on a number of factors. Significant factors may include, for example, the operating cost and the productivity of the machine or system.

The productivity and the cost of operating a machine, or a fleet of machines, may be adversely affected by a number of factors. For example, an operator of a wheel tractor scraper may spend too much time in a load cycle relative to the time required to complete a haul cycle. A heavily laden machine, resulting from a long load cycle, may be efficient in terms of real productivity and cost for certain haul cycles, but for other haul cycles may deteriorate productivity and increase cost by increasing tire slip (increased tire wear), burning more fuel, increasing wear on ground engaging tools, and increasing wear on machine structure and powertrain components, for example.

Systems have been designed with a view toward increasing the efficiency of earthmoving machines. For example, U.S. Pat. No. 6,336,068, issued to Lawson et al. on Jan. 1, 2002 ("the '068 patent"), discloses a control system for a wheel tractor scraper. The '068 patent further discloses that the four operating modes (loading, hauling, ejecting, and return) may be automated via control modules and sensors. Initially, an operator may enter values for various machine operations into the control system. During earthmoving operations, the operator may activate the several operating modes via a toggle switch, push button, etc.

While the system of the '068 patent may increase machine efficiency through automation of certain aspects of machine operation, operating costs may still be too high and machine productivity may still fall below optimum levels. The system of the '068 patent does not give any indications that certain cycle characteristics are taken into consideration during automation. For example, the '068 patent does not disclose considering factors such as the length of the haul phase of the cycle, grade to be negotiated, ground character, and/or load growth curve for the machine, for example. Therefore, while the system of the '068 patent may improve over manual machine control and provide a degree of automation, it may fall well short of optimizing operating cost and machine productivity.

The present disclosure is directed to one or more improvements in the existing technology.

SUMMARY OF THE INVENTION

In one aspect, the present disclosure is directed to a method for enhancing productivity for an excavating machine. The method includes determining at least one cycle characteristic for an operating cycle of the excavating machine. The method also includes measuring payload accumulated by the machine during a load phase of an operating cycle of the excavating machine. The method further includes controlling payload accumulated by the machine based on the at least one determined cycle characteristic.

In another aspect, the present disclosure is directed to a system for enhancing productivity in loading and transporting a quantity of material. The system includes a mobile machine including a payload carrier configured to engage material to be loaded during a load phase, and configured to be raised from engagement with the material during a haul phase. The system also includes a control system associated with the machine and configured to control the payload loaded by the machine based on at least one cycle characteristic of the machine.

DETAILED DESCRIPTION

Figure 1:
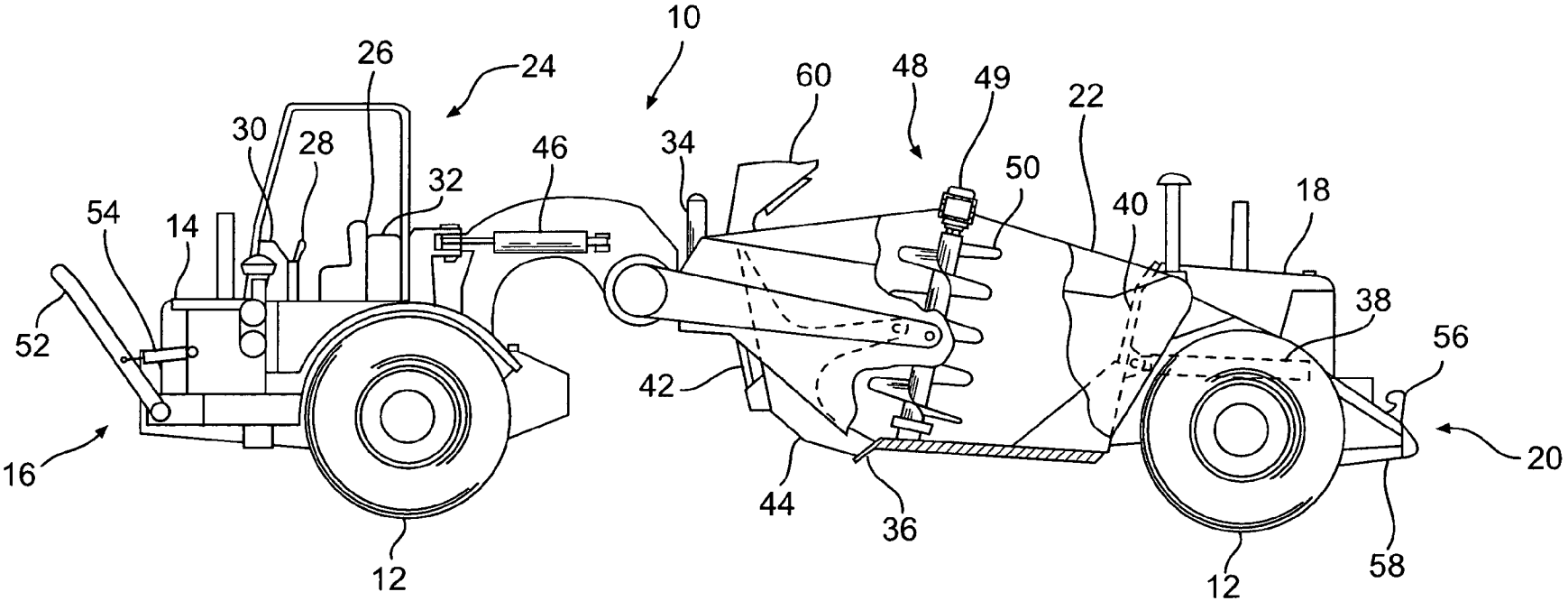
FIG. 1 is a diagrammatic illustration of a machine according to an exemplary disclosed embodiment.

FIG. 1 diagrammatically illustrates a machine 10 which may be, for example, a wheel tractor scraper. It will be understood that machine 10 may include various machines that may be characterized as wheel tractor scrapers, pull-pans, etc. Machine 10 may include one or more traction devices, such as front and rear wheels 12, enabling the machine to function as a mobile unit. A suitable power source 14, e.g., a diesel engine, may be located at the front 16 of the machine 10. An additional power source 18, which also may be a diesel engine, may be included at the rear 20 of the machine 10. A payload carrier 22 may be located intermediate the front and rear of the machine 10, enabling the machine to transport a quantity of material, such as earth. The payload carrier 22 of a wheel tractor scraper is a container which may receive and hold material for transport, and may sometimes be referred to as a scoop or bowl.

Machine 10 may further include an operator station 24. Operator station 24 may include an enclosed or partially enclosed cab, and may include an operator seat 26, suitable operator control devices 28, and a display device 30. Machine 10 also may include a suitable control system, including a controller 32, various detectors or sensors, and various actuators for operating the several components associated with the machine. For example, machine 10 may include one or more actuators 34, e.g., hydraulic cylinders, for raising and lowering the payload carrier 22. The one or more actuators 34 may lower payload carrier 22 such that ground engaging tool 36, typically located at the lower front edge of payload carrier 22, may penetrate material to be loaded during a load phase of the machine 10, and may raise the payload carrier 22 for transportation of the payload during a haul phase of machine 10.

Additional actuators may include actuator(s) 38 for moving an ejector 40 during a dump phase, and actuator(s) 42 for controlling an apron 44. Apron 44 may be moved from engagement with the front portion of payload carrier 22 to an open position by actuator(s) 42 during both load and dump phases, and maintained in a closed position engaged with the front portion of the payload carrier 22 during a haul phase by reverse movement of actuator(s) 42. Apron 44 may operate synchronously with ejector 40 during a dump phase, with actuator(s) 42 moving apron 44 to an open position and actuator(s) 38 moving ejector 40 within payload carrier 22 to assist in dumping the payload. Steering of machine 10 may be facilitated by a steering unit including one or more actuators 46 located, for example, at a position between the payload carrier 22 and the front 16 of machine 10.

As illustrated in FIG. 1, a suitable load assist unit 48 may be associated with the payload carrier 22. The optional, diagrammatically illustrated load assist unit 48 is representative of various load assist units that may be employed, including, for example, auger units or elevator units. In FIG. 1, the load assist unit 48 is illustrated as an auger 50. It will be understood that the load assist unit may include a plurality of augers, an elevator unit, or other expedients which may assist the loading of material into payload carrier 22. Load assist unit 48 may be driven by a suitable machine actuator, e.g., a rotary hydraulic actuator 49.

It is sometimes expedient that loading of machine 10 may be assisted by a pull unit or by a push unit, and it is at times expedient that loading may involve multiple machines working in what is sometimes referred to in the art as push/pull operation. To enable such operation, machine 10 may be provided with a suitable mechanism such as bail 52 at the front 16 of the machine. An actuator 54, for example, may be provided to manipulate the bail 52 of machine 10. Machine 10 may additionally include a pulling hook 56 associated with a push block 58 at the rear 20 of the machine. One machine 10 may assist loading of another machine 10 by pushing against push block 58 (to load a front machine by pushing), or by engaging a bail 52 of one machine with a pulling hook 56 of another machine 10 (to load a rear machine by pulling).

Other suitable mechanisms to assist in loading of machine 10 are contemplated, including, for example, pushing and/or pulling of a machine 10 with one or more machines of another type, such as, for example, a track type tractor. A suitable measuring or detecting device may be employed to ascertain payload parameters. For example, during loading, a measuring unit or detector, such as a camera 60, may be strategically mounted on the machine 10 so as to enable determination of the amount of material loaded and/or the speed with which material is loaded.

A machine 10 to which the disclosed method and system may be applicable, for example, a wheel tractor scraper, may operate in cycles that may include load, haul, dump, and return phases. In a given earth or material moving operation, such as that carried out by a wheel tractor scraper, machine cycles of operation may be affected by various parameters and/or factors which may be referred to as cycle characteristics. Consideration of cycle characteristics during machine operation may enable enhancement, optimization, and/or maximization of machine productivity, along with control of operation costs, through optimization of machine payload.

Cycle characteristics may include, for example, the length of the haul phase of a cycle, the grade to be negotiated by the machine, the character of the ground over which the machine must travel, the character of the machine (i.e., the machine size and manner of loading), the type of material loaded, and machine speed relative to the amount of payload. Another cycle characteristic that may be considered in connection with a wheel tractor scraper is the load growth curve. A load growth curve is a graphic representation of the increase in payload during machine loading. For a wheel tractor scraper, the load growth curve normally may indicate that most of the payload is loaded early during the load phase of an operating cycle, with gradually diminishing increase in payload later in the load phase.

Figure 2:
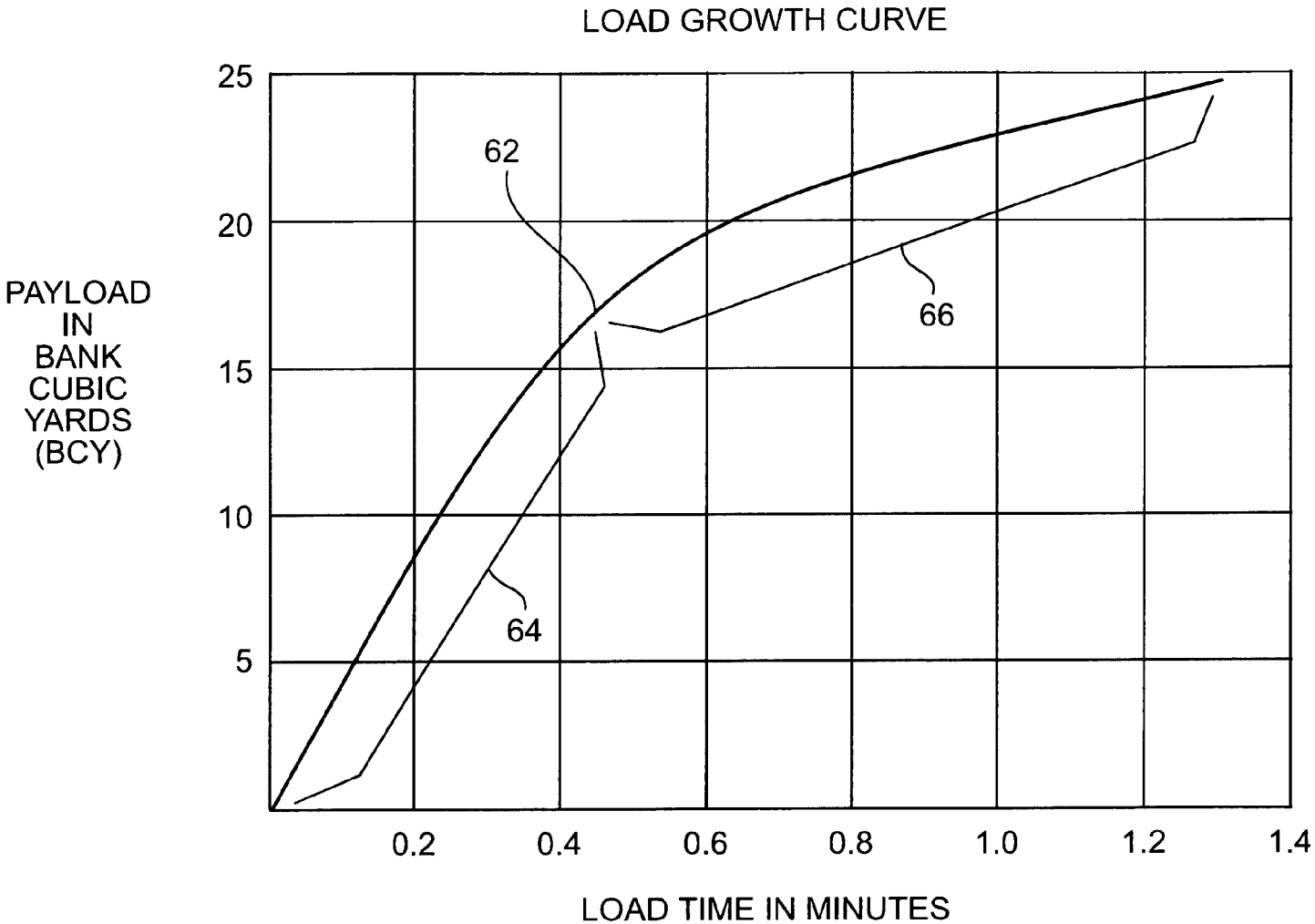
FIG. 2 is a graph according to an exemplary disclosed embodiment.

FIG. 2 graphically illustrates an exemplary load growth curve for a machine 10, such as a wheel tractor scraper. Referring to FIG. 2, payload is represented on the y-axis, and generally may be measured in bank cubic yards (BCY). Load time may be measured on the x-axis, with the unit of time in minutes and/or fractions thereof, for example. It can be seen in FIG. 2 that load growth curve 62 may exhibit a rather steep portion 64 during initial stages of loading, and may exhibit a less steep portion 66 as the load phase proceeds. The bulk of payload may be accumulated within the machine early in the load phase, corresponding to steep portion 64, with subsequent increase in payload gradually diminishing, corresponding to less steep portion 66. This characteristic shape for a load growth curve may be attributed to the fact that, as the payload carrier receives more and more material, later loaded material may be required to lift or force its way through previously loaded material.

Wheel tractor scrapers may have differing load growth curves, depending, for example, on the size of the machine, whether the machine is self-loading, whether the machine is push loaded, whether the machine is of the push-pull type, whether the machine including an expedient to augment loading (e.g., an elevator or auger), and the type of material loaded (e.g., clay, sand, gravel, mixture of rock and earth, etc.). The load growth curve for a given machine operating under a given set of circumstances may be determined empirically, in advance of actual production operation of the given machine. This may be accomplished by test operation and previous field experience, for example.

Load growth curve 62 for a given machine may be determined as the machine is being loaded. For example, camera 60 may provide controller 32 with instantaneous signals indicating the speed with which material is being loaded. Controller 32 may include a program or algorithm that enables on-going generation of data representing the load growth curve 62 based on signals received from camera 60, for example.

Controller 32 may include a central processing unit, a suitable memory component, various input/output peripherals, and other components typically associated with machine controllers. Controller 32 may include programs, algorithms, data maps, etc., associated with operation of machine 10. Controller 32 may be configured to receive information from multiple sources, such as, for example, one or more of the actuators 34, 38, 42, 46, and 54, camera 60, various sensors or detectors (e.g., for machine travel direction, ground speed, engine operation, etc.), as well as input from a machine operator via, for example, control devices 28. Controller 32 may be suitably located to send and receive appropriate signals to and from the various sensors, actuators, etc., associated with machine 10. As shown in FIG. 1, controller 32 may conveniently be located within or adjacent operator station 24.

Figure 3:
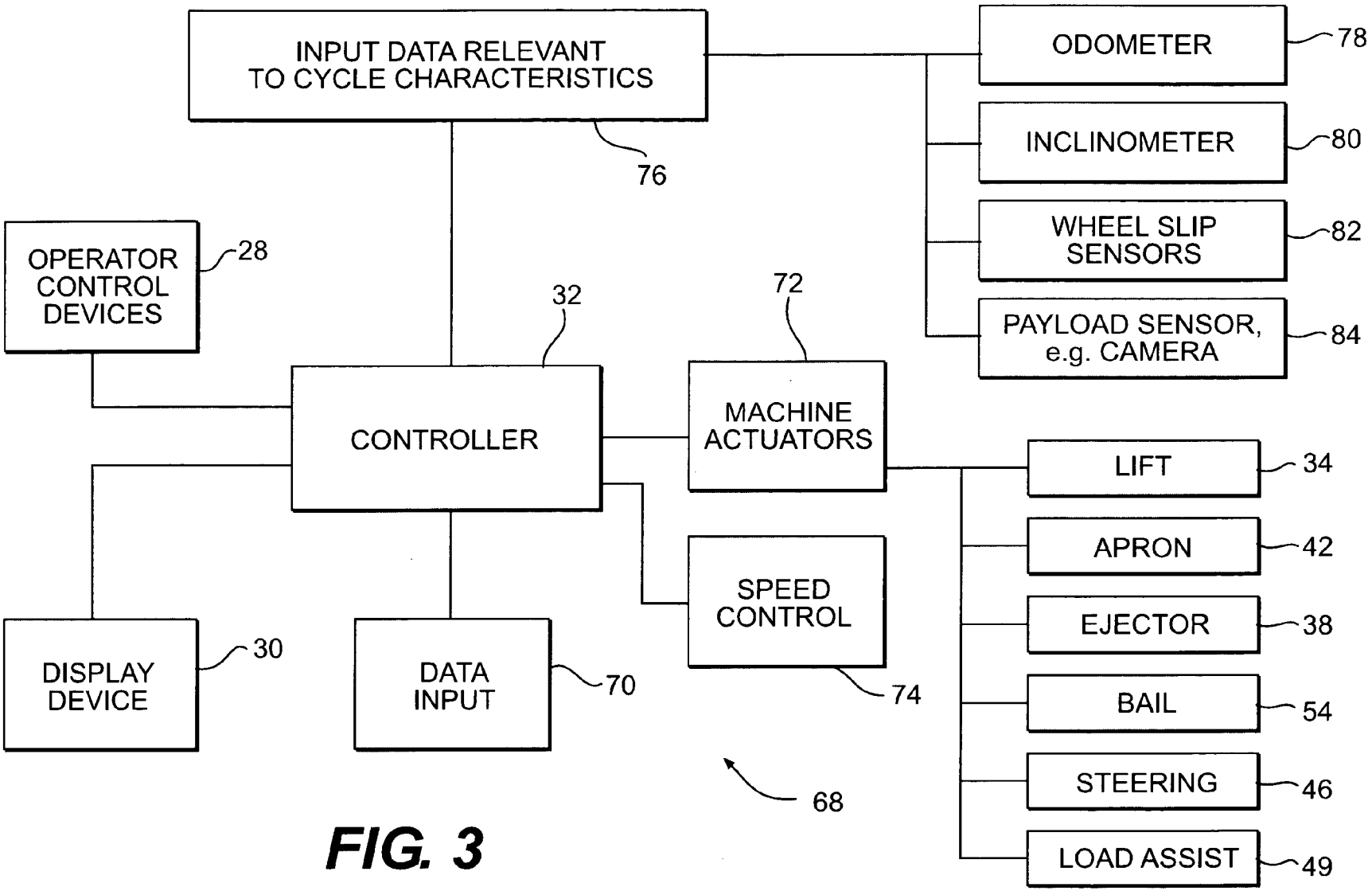
FIG. 3 is a schematic illustration of an exemplary control system.

An exemplary control system 68 for machine 10 is schematically illustrated in FIG. 3. Referring to FIG. 3, controller 32 may suitably communicate with various machine components, for example via conductors. Operator control devices 28 and display device 30 may enable an operator to manually supply signals to controller 32, and display device 30 may, for example, provide an operator with various information to enhance operator awareness of various machine systems and thereby facilitate maintaining effective and efficient machine operation. Controller 32 may receive data input 70 via various sources, including keyboards, a touch screen display (which, for example, may be associated with display device 30), computer discs, or other sources of data input known to those skilled in the art.

Controller 32 also may communicate with various machine actuators 72, including for example, the lift actuator(s) 34, apron actuator(s) 42, ejector actuators(s) 38, bail actuator 54, steering actuator(s) 46, load assist actuator(s) 49, and any other actuators associated with machine 10. Controller 32 may communicate with speed control 74 which may, for example, include various engine speed control expedients, transmission gear shifting, etc.

Input data relevant to cycle characteristics 76 may be communicated to controller 32, for example on an on-going basis. This may enable relatively continual updating of calculated optimum payloads for machine 10. For example, controller 32 may receive data from a machine odometer 78, an inclinometer 80, wheel slip sensors 82, payload sensor 84 (which may include camera 60, for example), and/or various other sensors, detectors, diagnostic devices, etc., that may be employed to gather data relevant to cycle characteristics.

Industrial Applicability

The disclosed method and system may be applicable to machines such as, for example, wheel tractor scrapers, which may operate in cycles that may include load, haul, dump, and return phases. In a given earth or material moving operation, machine cycles of operation may include various cycle characteristics. Cycle characteristics may include, for example, the length of the haul phase of a cycle, the grade to be negotiated by the machine, character of the ground over which the machine must travel, machine speed relative to the amount of payload, type of material loaded, type of machine employed, and load growth curve.

Figure 4:
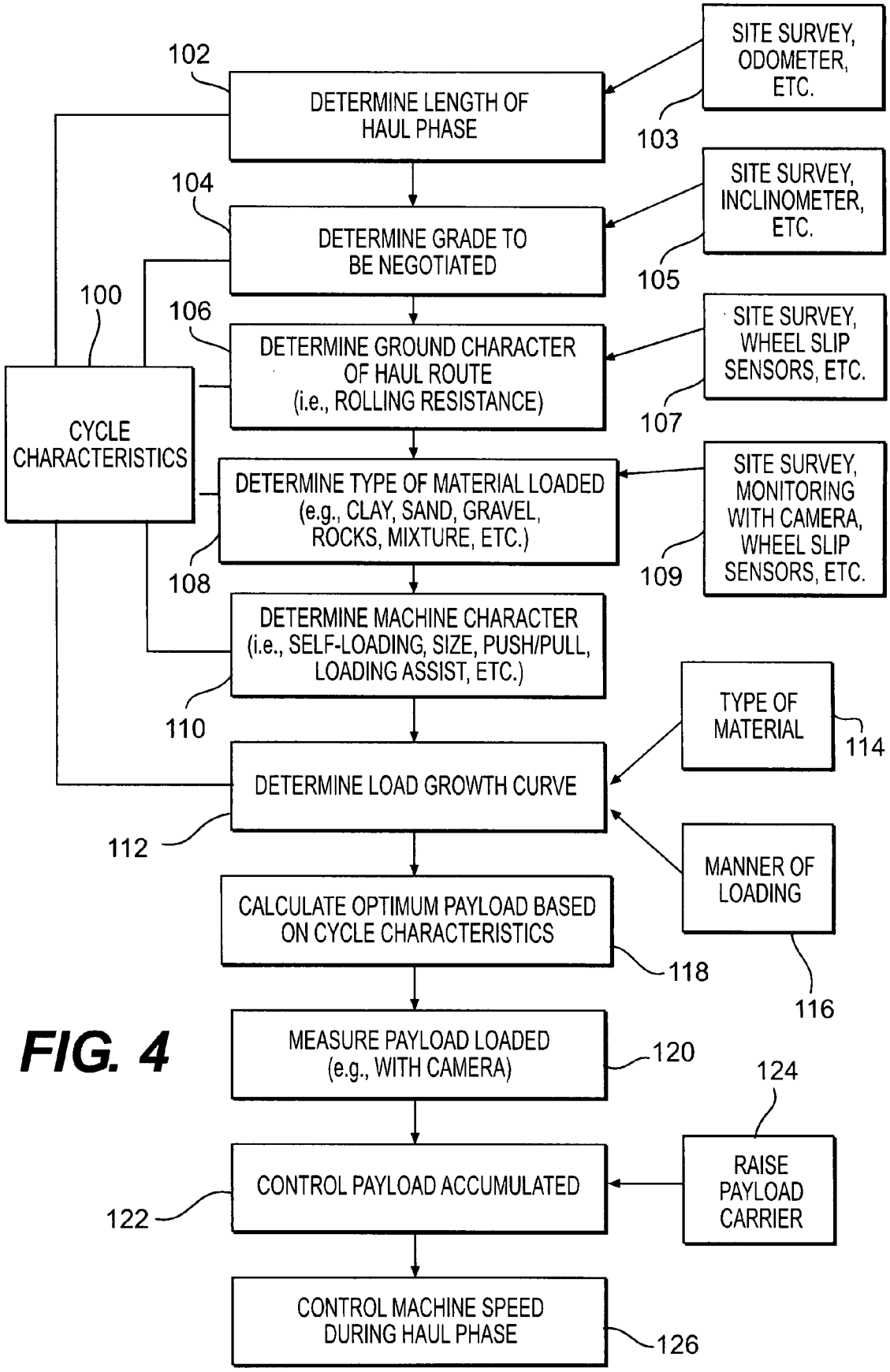
FIG. 4 is a block diagram representation of a system and method according to an exemplary disclosed embodiment.

FIG. 4 diagrammatically and schematically illustrates various aspects that typically may be involved in systems and methods in accordance with exemplary embodiments of the disclosure. It should be noted that, of the various items set forth in FIG. 4, all may not necessarily be present in a given machine operation cycle or series of cycles. For example, the disclosure contemplates systems and methods with fewer than the indicated cycle characteristics. In addition, the sequence of the various indicated items may vary, depending, for example, on the particular work site involved, the type of machine employed, etc.

Various cycle characteristics are represented generally at 100, and more specifically at 102-112. These cycle characteristics may significantly affect the optimum payload that machine 10 may carry during a cycle or series of cycles in order, for example, to maximize production and minimize cost. At 102, the length of the haul phase may be determined; at 104, the grade to be negotiated during a haul phase may be determined; at 106, the character of the ground over a haul route may be determined; and at 108, the character of the material loaded may be determined. The character of the ground over a haul route and the character of the material loaded may include, for example, clay, sand, gravel, rocks, or a mixture of rocks and earth. Data relevant to each of cycle characteristics 102-108 may be supplied to controller 32 via a suitable input device, for example.

The manner in which these cycle characteristics are determined may vary. For example, the haul length may be adequately determined by suitable site survey, odometer, etc. 103, for example. Since the haul length may be altered as the excavating operation progresses, controller 32 may be frequently updated with data regarding haul route length based on, for example, odometer measurements provide from odometer 78. Controller 32 may be provided with data relevant to grade and grade changes by a suitable site survey, inclinometer, etc. 105 for example. Since the grade may vary over the haul route, and may vary with time, controller 32 may be frequently updated with data regarding grade based, for example, on an inclinometer 80 associated with machine 10.

Controller 32 may be provided with data relevant to ground character over the haul route by a suitable site survey, wheel slip sensors, etc. 107, for example. Ground character may be analogous to, or be a substantial factor in, rolling resistance for machine 10. In addition, controller 32 may be provided with data relevant to the type of material being loaded by site survey, monitoring with a camera, wheel slip sensors, etc. 109, for example. Wheel slip sensors 82, for example, may be employed to provide data to controller 32 relevant to the amount of wheel slip the machine may experience, and give a relative indication of ground character, both with respect to haul route and material loaded. In addition, the type of material loaded may be monitored by camera 60.

Another cycle characteristic may be the character of the machine employed for the excavating operation. For example, wheel tractor scrapers may be of various sizes (power, capacity, etc.), and the choice of machine size may depend on the particular excavating operation to be undertaken. In addition, a wheel tractor scraper may be self-loading, or it may operate with a load assist mechanism, such as an auger arrangement or an elevator mechanism. Also, some wheel tractor scrapers may be provided with loading assist via another machine acting as a pusher, such as another wheel tractor scraper or a track-type tractor. Further, some machines act in a push/pull mode, whereby one machine pushes another to assist loading of the front machine, and then the front machine pulls the rear machine to assist it in loading. Determination of the machine character is represented at 110. Data relevant to the machine character may be supplied to controller 32 via a suitable input device, such as data input 70, for example.

The load growth curve is a cycle characteristic typical for wheel tractor scrapers. As discussed in connection with the graph illustrated in FIG. 2, the load growth curve 62 generally presents a shape that represents the realities of the load phase for a wheel tractor scraper. For example, the initial steep portion 64 of the curve indicates a greater volume of material loaded early in the load phase, with the amount of material loaded diminishing substantially during later stages of the load phase, represented by less steep portion 66. Determination of the load growth curve is represented at 112 and may be accomplished empirically. The load growth curve for a particular machine may depend on various factors including, for example, the type of material loaded, represented at 114, and the manner of machine loading, represented at 116.

Determination of the load growth curve also may be accomplished during actual machine operation by measuring the speed with which material accumulates in payload carrier 22. For example, camera 60 may be positioned to monitor material loading and send signals to controller 32 indicating the speed with which material is loaded. Controller 32 may include one or more programs or algorithms to calculate the load growth curve during an actual load phase of an operating cycle. In this way, a load growth curve, which may vary somewhat from cycle to cycle (e.g., as material composition changes, as weather conditions change, etc.), may be uniquely determined for a load phase of a given operating cycle, increasing the accuracy of calculations based on the load growth curve.

Machine controller 32 may be programmed with a suitable algorithm for determination of an optimum machine payload. Once relevant cycle characteristic data has been determined and provided to controller 32 by suitable input, optimum payload for a particular machine may be calculated at 118. The optimum payload may, if desired, then be displayed on machine display device 30. In addition, responsive to calculation of the optimum payload, controller 32 may act to generate suitable control signals for insuring that the machine functions to approach, as closely as possible, the calculated optimum payload.

In keeping with the desire to approach optimum payload as closely as possible, a suitable expedient for measuring the accumulated payload, at 120, may be employed. For example, camera 60, which may be strategically located to provide a view of the material entering the payload carrier 22 during loading, may not only aid determination of the speed with which material is accumulated in payload carrier 22, but also aid determination of the amount of accumulated payload. Camera 60 may be mounted on the machine structure on a portion of payload carrier 22, for example on a mast or stalk, so as to yield a view of the material entering the payload carrier and accumulated therein. Camera 60 may advantageously provide a relatively instantaneous manner for determining both the speed of payload accumulation and the quantity of payload accumulated. Camera 60 may suitably communicate with controller 32 so as to deliver a signal to controller 32 indicating, for example, both material accumulation speed and quantity of material accumulated within the payload carrier 22.

At some point during the load phase, payload carrier 22 may reach a point approaching optimum payload. At this point, controller 32 may receive the signal from camera 60 indicating a quantity of material accumulated in payload carrier 22 commensurate with the optimum payload determined by controller 32. Controller 32 may then initiate a signal to control the payload accumulated to be, as close as possible, the calculated optimum payload, at 122. Control may include raising the payload carrier 22, at 124, via a suitable actuator or actuators 34, for example, so that ground engaging tool 36 is removed from ground contact. Raising the payload carrier 22 may be accompanied by cessation of loading assist by any auxiliary load assist mechanism, such as load assist unit 48, or cessation of any load assist provided by any machine acting as a pusher.

Once optimum payload, as closely as possible, has been reached, and payload carrier 22 has been raised so that the ground engaging tool 36 no longer engages the ground, the load phase has ended and the machine is ready for a haul phase. Controller 32 may suitably control the machine speed during the haul phase, at 126, to ensure that the optimally loaded machine travels at the speed commensurate with maintaining the payload within the optimum range. An otherwise optimum payload may vary widely from optimum if a machine moves too fast or too slowly. Grade and ground character may dictate the appropriate speed to maintain fuel efficiency, reduce tire wear, and reduce machine stress, and changing grade within a haul route may dictate speed alterations in order to maintain machine operation with optimum payload.

It should be noted that the cycle characteristics determined at 102-112 are exemplary, and not exclusive of other cycle characteristics which may exist in given situations. For example, weather-related phenomena may significantly affect machine operation and cycle efficiency. In addition, breaks in productive operation, such as breaks by operator personnel for meals, refueling stops, short periods of machine maintenance, and consultations with site supervisors may alter cycle efficiency.

The disclosed systems and methods may enable optimization of payload with an accompanying enhancement, maximization, and/or optimization of productivity and minimizing of cost. Any tendency for a machine operator to employ a load phase of an operating cycle that inappropriately accounts for the haul phase may be mitigated or removed. In general, a short haul phase may dictate a short load phase, while a long haul phase may dictate a long load phase to achieve full machine capacity. However, this rule of thumb may not sufficiently approach either an optimum payload or maximized productivity. With the disclosed systems and methods, a degree of automation may be achieved which may take into account, on an on-going basis, various cycle characteristics. Payload may reliably be optimized and productivity maximized by altering the length of time for a load phase of an operating cycle based on, for example, the length of time of a haul phase of an operating cycle.

It is to be noted that the terms "maximization" and "optimization" are to be construed herein, not in the sense of an achieved ideal, but in the sense of strategically targeted objectives to be approached as closely as is reasonably possible. Those skilled in the art will recognize that absolute maximization and/or optimization of payload, efficiency, productivity, etc., may be elusive goals. However, the exemplary embodiments disclosed herein approach both optimization of payload and maximization of productivity, for example by appropriate consideration of machine cycle characteristics in the disclosed exemplary embodiments.

It will be apparent to those skilled in the art that the methods and systems disclosed herein may be applicable to machines other than those generally characterized as wheel tractor scrapers. For example, a pull-pan is a machine that may include load, haul, dump, and return phases in operating cycles in a manner somewhat similar to those employed by a wheel tractor scraper. A pull-pan may be roughly similar to the payload carrier portion of a wheel tractor scraper, and may be pulled behind a tractor unit. In some cases, multiple pull-pans may be pulled behind a tractor unit in tandem. Integration of cycle characteristics into machine control for pull-pan systems to achieve optimum payload and thus maximize production and reduce operating costs in accordance with the systems and methods disclosed herein is contemplated.

It will be apparent to those skilled in the art that various modifications and variations can be made to the disclosed payload overload control system without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. An earthmoving system for optimizing productivity in loading and transporting a quantity of material, the earthmoving system comprising:

a mobile machine including a payload carrier configured to engage material to be loaded during a load phase of an operating cycle, and configured to be raised from engagement with the material during a haul phase of the operating cycle; and a control system associated with the machine and configured to:

calculate an optimum payload for the operating cycle based on at least one cycle characteristic of the machine, and control the payload loaded by the machine based on the calculated optimum payload;

wherein the at least one cycle characteristic includes a load growth curve based on a type of the material loaded and a manner in which the machine is loaded, and the control system is configured to control the payload loaded based on the character of the load growth curve.

2. The system of claim 1, wherein the control system is configured to determine the load growth curve for the machine during machine operation.

3. A machine, comprising:

front and rear ground supporting units;

a payload carrier intermediate the front and rear ground supporting units, the payload carrier being configured to be loaded with material to permit the machine to transport the material during an operating cycle;

a steering unit for steering the machine during transport of the material;

at least one power source for delivering power to the machine;

a system configured to measure a quantity of the material loaded into the payload carrier, the system including at least one camera strategically located to provide a view of the material entering the payload carrier during loading, the camera being configured to supply a signal to the controller indicative of a speed of material accumulation within the payload carrier; and a controller configured to determine an optimum payload for the operating cycle based on at least one cycle characteristic of the machine, and control the quantity of the material loaded into the payload carrier based on the determined optimum payload;

wherein the controller is configured to determine a load growth curve for the machine based at least on the signal indicative of the speed of material accumulation within the payload carrier.

4. The machine of claim 3, wherein the load growth curve indicates a change in an amount of the material loaded over time.

5. The system of claim 1, wherein the load growth curve indicates a change in an amount of the payload loaded over time.

* * * * *